US007112117B2

(12) United States Patent
Horta et al.

(10) Patent No.: US 7,112,117 B2
(45) Date of Patent: Sep. 26, 2006

(54) GARMENT UNDERWIRE WITH ZONES OF DIFFERING FLEXIBILITY

(75) Inventors: Joseph Horta, Yonkers, NY (US); Ajit Thakur, Eagleville, PA (US)

(73) Assignee: S & S Industries, Inc., Long Island City, NY (US)

( * ) Notice: Subject to any disclaimer, the term of this patent is extended or adjusted under 35 U.S.C. 154(b) by 0 days.

(21) Appl. No.: 11/061,416

(22) Filed: Feb. 18, 2005

(65) Prior Publication Data

US 2005/0197043 A1 Sep. 8, 2005

Related U.S. Application Data

(63) Continuation-in-part of application No. 10/245,470, filed on Sep. 16, 2002, now Pat. No. 6,857,933.

(51) Int. Cl.
*A41C 3/14* (2006.01)
*A41C 3/10* (2006.01)

(52) U.S. Cl. ..... 450/41; 450/51; 450/52; 2/255; 2/259

(58) Field of Classification Search ..... 450/41–52; 28/255–259, 262, 264, 260, 260.1, 261, 263
See application file for complete search history.

(56) References Cited

U.S. PATENT DOCUMENTS 2,782,417 A 2/1957 Magidson
3,562,802 A 2/1971 Avis
3,747,606 A 7/1973 Tareau
3,777,763 A 12/1973 Schwartz
4,271,580 A 6/1981 King et al.
4,770,650 A 9/1988 Rowell
5,141,470 A 8/1992 Morgan
5,219,311 A 6/1993 Fildan
5,730,640 A 3/1998 Acx et al.
5,951,365 A 9/1999 Fildan
6,066,027 A 5/2000 Fildan
6,152,802 A * 11/2000 Horta et al. ..... 450/48
6,468,130 B1 * 10/2002 Thakur et al. ..... 450/41
6,575,811 B1 * 6/2003 Fildan et al. ..... 450/41
6,857,933 B1 * 2/2005 Horta et al. ..... 450/41

* cited by examiner

*Primary Examiner*—Gloria M. Hale
(74) *Attorney, Agent, or Firm*—Abelman, Frayne & Schwab

(57) ABSTRACT

An underwire including an arcuate member for use with supporting garments, such as brassieres, has one or more zones of increased lateral flexibility along the longitudinal axis of the arcuate member in order to provide greater comfort to the individual wearer, without substantially affecting the arcuate rigidity that provides support. The increased flexibility is provided to the zones of increased flexibility by reducing the cross-sectional area of one or more end portions by tapering one or more sides, by sequentially and progressively stamping increasing numbers of incremental portions of the end portion in a stamping apparatus, to taper one or two opposed surfaces of the arcuate member. Alternatively a single step stamping method can be utilized to provide the flexible end portion.

30 Claims, 11 Drawing Sheets

FIG. 1A
PRIOR ART
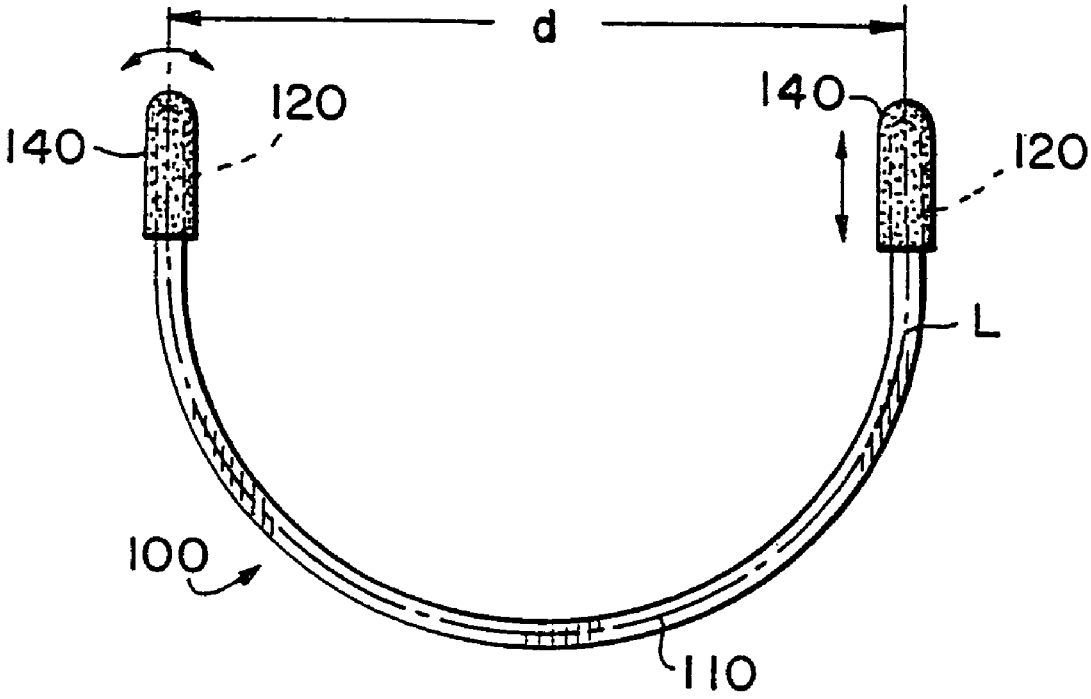
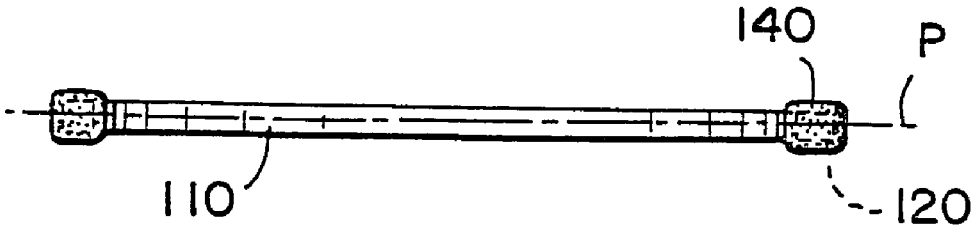
FIG. 1B
PRIOR ART

FIG. 11A
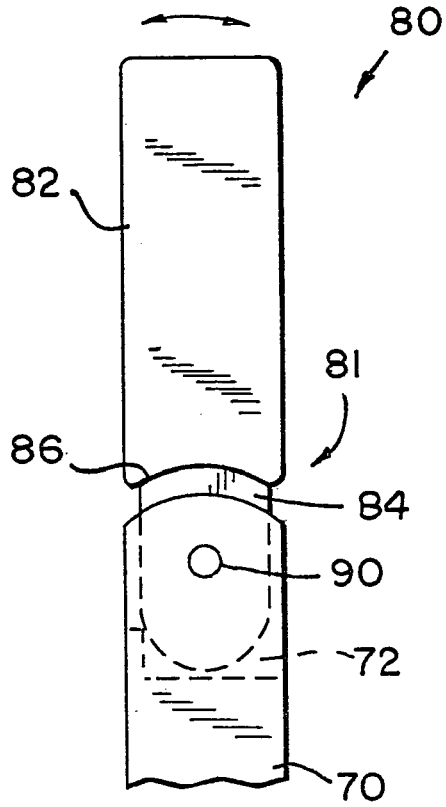
FIG. 11B
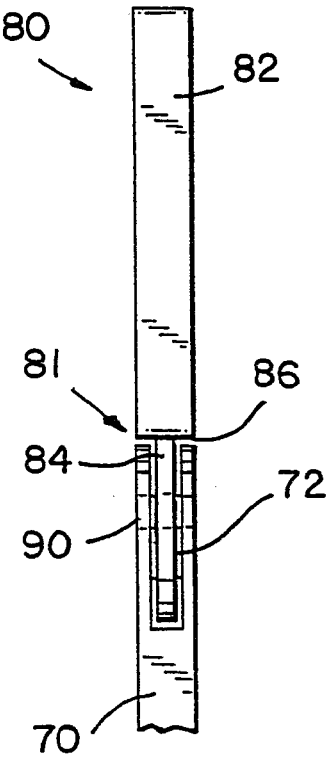
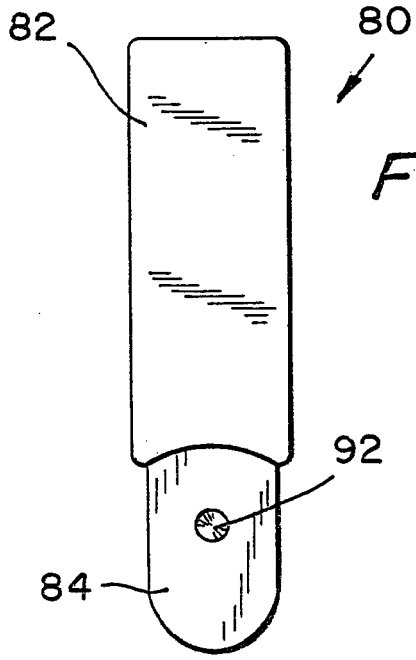
FIG. 12A
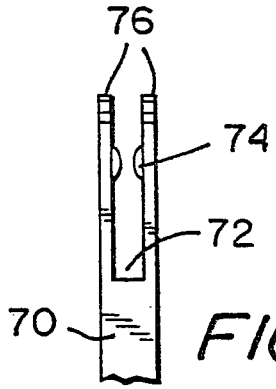
FIG. 12B

GARMENT UNDERWIRE WITH ZONES OF DIFFERING FLEXIBILITY

CROSS-REFERENCE TO RELATED APPLICATIONS

This application is continuation-in-part of U.S. patent application Ser. No. 10/245,470, filed Sep. 16, 2002, now U.S. Pat. No. 6,857,933, issued Feb. 22, 2005, the disclosure of which are claimed priority to and incorporated herein by reference and made a part of this disclosure.

BACKGROUND OF THE INVENTION

1. Field of the Invention

The present invention relates to underwires used in supporting garments. As used herein, the term "supporting garments" is intended to include brassieres, corsets, swimsuits, peignoirs and other foundation garments that have breast-supporting cups.

2. Description of the Related Art

Brassieres and similar supporting garments typically include an underwire in the form of a semi-rigid stiffening member of a generally arcuate U-shape that is positioned below the breast cup to provide increased support to the garment. The underwire is placed in an appropriately shaped fabric pocket or sleeve that extends from the central portion and along the lower and outside portions of the breast cup to a position at the wearer's side, under the arm. The resilient underwire of the prior art can be made of a metal, such as steel, having a rectangular, oval or other cross-section, or from polymeric materials in a variety of cross-sectional shapes.

As manufactured, a U-shaped underwire of the prior art has a length "L" defined by a longitudinal axis extending from one end to the other. The underwire also lies flat in an unstressed state, its longitudinal axis lying in a plane. As used herein, "longitudinal plane" means the plane in which the longitudinal axis of the unstressed arcuate member lies.

When fabricated from metal, the underwire will twist when subjected to a torque applied to its ends. A lateral force applied normal to the plane of the to longitudinal axis at a point near one end will also produce a twisting, or torsional movement of the underwire. However, the prior art underwires are essentially stiff and rigid and, resist flexing or bending in the portions at either end of the underwire.

When assembled in the supporting garment, the outer end portion or terminus of the underwire is positioned in a soft fleshy area of the wearer adjacent to, or under the arm. The application of lateral forces by the end portion associated with the wearer's movements can be uncomfortable. This discomfort arises because the end portion of the underwire is too rigid to flex or twist outwardly in response to these forces. As a result, the rigid end portion of the underwire, including any cushion tip, presses uncomfortably on, and into the wearer's flesh.

The ends of the underwire, one of which will generally be along the side of the breast proximate the wearer's arm, and the other of which will generally be at the cleavage portion of the breast, distal the wearer's arm, are stiff and rigid, and typically include sharp corners or edges as manufactured. During movement the rigid ends of the underwire, and other portions intermediate the ends, can press uncomfortably against or into the wearer at particularly sensitive portions of the wearer's body. This discomfort is most commonly experienced by wearers of larger cup sizes, individuals having a fleshy torso and those engaged in physical activity that includes stretching, turning and twisting the torso.

In order to alleviate this discomfort, it is well known to provide a soft auxiliary cushion tip of plastic or the like, at the ends of the underwire. Such cushion tips are described in U.S. Pat. Nos. 5,830,040, 3,777,763 and 3,608,556, and represent efforts to provide greater comfort to the wearers of supporting garments constructed with underwires. In this type of prior art underwire, this tip is referred to as a "Comfort Tip".

It is also known to coat the entire length of the arcuate member with a polymeric composition and to provide an enlarged tip at either end, usually of a different type and/or color of polymer or plastic material. The coated underwire and plastic tip can be prepared by spraying and/or dipping the underwire into a liquid composition. In this type of prior art underwire, the tip is referred to as a "hard tip" or "dip tip".

The need for a soft cushion tip such as those disclosed above is also particularly critical should an end of the underwire break through the sleeve or cover of the brassiere that contains the underwire. This can occur after repeated machine washings of the brassiere. Whether the soft coated underwire cushion tip remains within or extends through fabric cover, the tip and end portion of the arcuate member is relatively rigid or stiff and uncomfortable.

In addition, underwires of conventional design do not always allow garments in which they are fitted to flexibly follow movements of the body of the wearer. This is particularly so for wearers requiring a larger cup size, when the wearer leans forward, bends over or twists the torso in such a manner that the tip presses into the sensitive side of the torso and/or breast causing discomfort. While imparting firmness to the supporting structure of the brassiere, underwires of the prior art often do not provide the flexibility necessary for the comfort of the individual wearer. For example, pressure points or sections along the longitudinal axis of the semi-rigid underwire can press uncomfortably against the wearer's ribs and/or flesh.

Other portions along the length of the rigid arcuate member can press against the wearer's torso to create zones of discomfort. These other zones can include the underbust, the breastbone, the rib cage and the region between the underbust and breastbone. As will be understood by one familiar with the art, as well as wearers of supporting garments who have experienced the discomfort and have no experience or interest in designing such garments or underwire assemblies, the precise position will vary with the type, size and style of the supporting garment, as well as the anatomical proportions, posture and physical activities of the wearer.

While soft plastic cushion tips and other alternative underwire constructions have generally achieved commercial and wearer acceptance, there exists a need to provide an improved underwire that exhibits enhanced flexibility at one or more positions along the longitudinal axis and end portions to overcome these and other disadvantages associated with existing underwires.

Accordingly, it is a primary object of the present invention to provide an underwire for supporting garments, such as brassieres, having at least one portion configured for increased lateral flexibility.

Another object of the invention is to provide an underwire of metal or polymer in which the end portion which may support a cushion tip, has greater flexibility in response to lateral forces produced by the wearer.

A further object of the present invention is to provide a garment that is provided with an underwire having at least one end portion configured for increased lateral flexibility to provide enhanced wearer comfort.

As used herein, the term "lateral force" means a force applied in a direction that is normal to the longitudinal axis or longitudinal plane of the underwire in its flat, unstressed condition.

As used: herein, the term "flexibility" means the extent to which a portion of an underwire will elastically bend in response to the application of a lateral force, where the lateral force applied does not permanently deform the underwire.

As used herein, "enhanced flexibility" means that a portion of the underwire is relatively more flexible and exhibits greater flexibility in response to the application of a lateral force than an adjacent portion of the underwire.

Another object of the invention is to provide a garment that is specifically designed and constructed to receive a custom-fit underwire assembly that is inserted into the garment at the point of sale to provide maximum comfort to the individual wearer.

A further object is to provide a garment that is constructed to receive an underwire of the present invention that is fitted into and secured in place in the garment.

SUMMARY OF THE INVENTION

The above objects and other advantages are obtained by the improved underwire of the invention that comprises an arcuate or curved, generally U-shaped resilient stiffening frame member having at least one end portion defining a zone of increased flexibility.

When an underwire having only one end portion provided with a zone of increased flexibility is used in the construction of a supporting garment, e.g., a brassiere, that end portion will be positioned, in one preferred embodiment, at the outside of the breast under the wearer's arm. The zone of increased flexibility is more responsive to a lateral force applied to the side of the garment and enhances the comfort of the underwire for the wearer by permitting increased lateral movement and flexibility of the underwire with the garment, particularly during physical activity and upper body movements.

Although providing a zone of increased flexibility at the outer end portion of the arcuate member improves comfort for most wearers of supporting garments, it should be understood that the zone of increased flexibility can be at one or more other positions along the longitudinal axis of the arcuate member. Thus, in its broadest aspect the invention contemplates providing one or more of such zones to customize the underwire to the specific type, style, construction and size of the garment in which it is utilized for the purpose of maximizing the comfort of the individual wearer.

In one preferred embodiment, the zone of increased flexibility includes a predetermined minor length of an end portion that is defined by a substantially smaller cross-sectional area than the cross-sectional area of the remaining portion of the underwire. The smaller cross-sectional area is produced in a conventional metal underwire by reducing the thickness of the arcuate member in a direction normal to the longitudinal axis. The zone of increased flexibility can also be provided by heat treatment, work hardening and by other methods known in the metal working arts. It can also be provided by configuring mold designs in the case of polymeric materials.

In one alternative embodiment, both end portions of the arcuate member define zones of increased flexibility relative to an intermediate portion. The relative flexibility of the respective end portions can be the same or different.

In another alternative embodiment, one or more intermediate portions of the arcuate member define zones of increased flexibility. These one or more intermediate portions can be in combination with such zones at one or both end portions.

As will be apparent to one of ordinary skill in the art, it may be desirable to prepare prototype underwires in accordance with the invention for evaluation in supporting garments of different sizes, materials of construction, designs and styles.

For example, the underwire utilized in a corset differs from that used in a peignoir or lightweight supporting garment. For such purposes of evaluation, the one or more zones of enhanced flexibility can be formed by thinning or removing underwire material, such as by grinding or abrading a predetermined length at one or both of the end portions, and/or one or more intermediate portions of a prior art underwire to achieve the desired smaller cross-sectional area. They can also be formed by joining materials of different cross-sections, or having different flexing properties.

In another preferred embodiment, the zone of increased flexibility is provided by perforating at least one portion of the arcuate member of the underwire to reduce the volume of material and thereby provide greater lateral flexibility in response to a lateral force originating in the wearer's torso. Again, prototypes for evaluation can readily be provided by drilling, machining, or otherwise modifying commercially available metal or polymeric underwires of the prior art.

Regardless of the manner in which the one or more zones of increased flexibility are provided, it is to be understood that the arcuate rigidity of the assembly should be maintained to the extent required to assure the proper form fitting of the garment. That is, the arcuate rigidity should not be substantially reduced.

The first and second ends are also preferably provided with cushion tips of a soft material, such as a soft polymeric material, to cover the metal at the outermost ends of the underwire. The tips can be fixed or movably mounted and can be configured and fitted or applied to the ends of the underwire in accordance with any of the forms, shapes, materials and methods now known and utilized in the prior art, or that may be developed in the future.

In another embodiment of the invention, the outer end portion of the arcuate member comprising the zone of increased flexibility is permanently turned or twisted at an angle of from about 30° to 90° from the longitudinal plane.

Thus, in one preferred embodiment the improved underwire of the invention broadly contemplates:

a generally U-shaped arcuate member the longitudinal axis of which lies in a plane, the arcuate member having a first portion extending from a first end that includes a majority of the length of the arcuate member, and a second portion that includes the remainder of the arcuate member, the second portion having a substantially greater flexibility than the first portion in response to a force applied in a direction normal to the plane of the longitudinal axis of the arcuate member, whereby the second portion defines a zone of increased flexibility.

In another preferred embodiment, the invention further contemplates an underwire for use in supporting garments comprising:

a generally U-shaped arcuate member the longitudinal axis of which lies in a plane, the arcuate member having a first end portion extending a pre-determined distance from a first end of the arcuate member, a second end portion extending a predetermined distance from the other end-of the arcuate member, and an intermediate portion extending between the first and second end portion, at least one of the first end, second end and/or intermediate portions including a zone of increased flexibility that has a substantially greater flexibility than a contiguous adjacent segment in response to a force applied in a direction normal to the plane of the longitudinal axis of the arcuate member.

In yet another preferred embodiment, the invention contemplates an underwire with a polymeric coating to enhance comfort to the wearer.

The invention also includes a brassiere or other supporting garment that incorporates the underwire of the invention carried in a channel or sleeve sewn into the garment, where at least the end portion of the underwire lying at the side of the garment has a zone of greater flexibility than the adjacent central portion of the underwire. In this context, the invention contemplates an underwire for a brassiere to comprising:

a substantially U-shaped frame member having a first terminal end portion, a second terminal end portion and an intermediate portion located between and integral with each of the terminal end portions;

the first terminal end portion assembled in the garment at a location proximate a wearer's arm, the first portion defining a flexible zone of predetermined length having a reduced cross-section and/or a plurality of perforations, and the second terminal end portion comprises a flexible zone of a predetermined length having a plurality of perforations, wherein the first and second terminal end portions have greater lateral flexibility than the intermediate portion.

In yet a further improvement in the comfort of the supporting garment, the arcuate member is provided with a hinge member proximate at least one end portion, the axis of the hinge being aligned to permit movement of the end portion of the arcuate member in response to a force applied normal to the plane of the longitudinal axis. The hinge member is constructed to resist flexing or deformation forces that are parallel to the longitudinal plane of the underwire. This permits the underwire to perform its shape-retaining function, while providing improved comfort to the wearer. In use, the hinged segment of the arcuate underwire member is preferably assembled to the garment in a close-fitting sleeve that can be formed from a shape-retaining fabric. Thus, the sleeve itself will also determine the eventual flexibility of the end portion of the hinged arcuate member.

The use of a hinge member is preferred in underwires fabricated from polymeric materials. The use of polymeric compositions allows the end portion and adjacent portion of the arcuate member to be molded with a so-called living hinge, a ball joint, or with rotationally interlocking elements. The hinge pin can also be integrally molded, if desired.

In another embodiment, the underwire for brassieres comprises a substantially U-shaped frame member having a first terminal end portion, a second terminal end portion and an intermediate portion. The intermediate portion is located between and integral with the first and second terminal end portions.

The second terminal end portion comprises a flexible zone of predetermined length and is tapered such that the second terminal end portion has greater flexibility than the intermediate portion.

The taper of the flexible zone is at an acute angle to the longitudinal axis and reduces the cross-sectional area transverse to an axis defined by the underwire from an initiation of the taper to a tip of the second terminal end portion.

In another embodiment, the underwire is for use in supporting garments and comprises a generally U-shaped arcuate member the longitudinal axis of which lies in a plane. The arcuate member has a first portion extending from a first end that includes a majority of the length of the arcuate member and a second portion that includes the remainder of the arcuate member. The second portion is tapered in at least one plane which contains the longitudinal axis, to provide substantially greater flexibility than the first portion in response to a force applied approximately perpendicular to said plane of the taper such that the second portion defines a zone of increased flexibility.

The taper in this embodiment can be in one plane and reduce the cross-sectional area transverse to the longitudinal axis of the second portion from an initiation of said second portion to a tip of the second portion. The taper can also be in two planes and reduce the cross-sectional area transverse to-the longitudinal axis of the second portion from an initiation of the second portion to a tip of the second portion. The taper in at least one plane defines a plane at an acute angle to the longitudinal axis. The taper can be in one or two planes. The taper including two planes can be converging planes.

In still another embodiment, an underwire for a brassiere comprises a substantially U-shaped frame member having a first terminal end portion, a second terminal end portion and an intermediate portion located between and integral with the terminal end portions. The first terminal end portion is assembled in the garment at a location proximate a wearer's arm and comprising a flexible zone of predetermined length having a taper. The second terminal end portion also comprises a flexible zone of predetermined length having a taper such that the first and second terminal end portions have greater flexibility in the plane of the taper than the intermediate portion.

The underwire in this embodiment defines a longitudinal plane and at least one of the terminal end portions has a taper oriented for flexing in a direction transverse to the longitudinal plane. The underwire can define a longitudinal axis and at least one of the terminal end portions has a plane of taper at an acute angle to the longitudinal axis oriented to flex in a direction approximately normal to the plane of taper.

In one embodiment, an underwire for supporting the cup of a brassiere cup comprises a generally U-shaped planar resilient arcuate member having a first portion extending along the longitudinal axis of the member approximately 65% to 90% of the length from a first end of the arcuate member. A second end portion has a taper which renders the second portion more flexible relative to the first portion. The second portion extends from its junction with the first portion to the second end of the arcuate member such that the second portion deflects more readily than the first portion in response to a force applied normal to the plane of the longitudinal axis of the member. The arcuate rigidity of the U-shaped member is substantially uniform along its length.

In this embodiment, the taper defines a surface having an acute angle to the longitudinal axis. The surface can be at least partially arcuate. The surface can also have one or more gradations of slope.

In still another embodiment, an underwire for use in supporting garments comprises an arcuate frame member having a first end portion, a second end portion and an intermediate portion located between and joined to the first and second end portions. At least one of the end portions comprises a tapered zone of flexibility produced by stamping the at least one end portion.

In this embodiment, the stamping can be performed in progressive increments along the length of the zone of flexibility. The stamping can be initiated at the tip and progressively extend along the length of the zone of flexibility. The zone of flexibility has a length and the length is stamped in its entirety into a taper. The arcuate frame member has a rectilinear cross-section transverse to a longitudinal axis including a width and a thickness and the zone of flexibility includes at least one side of the width being tapered along the longitudinal axis. The thickness of the frame member is uniform.

In this same embodiment, the frame member defines a longitudinal axis and the frame member at the initiation of the tapered zone of flexibility has a cross-sectional area transverse to the longitudinal axis at the initiation of the zone of flexibility greater than a cross-sectional area transverse to the longitudinal axis at said tip of the zone of flexibility. The stamping is on two opposed sidewalls of the zone of flexibility.

In another embodiment, an underwire for supporting a cup of a brassiere comprises a generally U-shaped planar resilient arcuate member having a first flat portion extending along the longitudinal axis of the member approximately 85% to 90% of the length from a first end of the arcuate member. A second end portion is tapered in at least one plane to render said second portion more flexible relative to the first portion extending from its junction with the first portion to the second end of the arcuate member. The second end portion deflects more readily than the first portion in response to a force applied normal to the plane of the longitudinal axis of the member and the arcuate rigidity of the U-shaped member is substantially uniform along its length.

This embodiment includes the taper in at least one plane defining an acute angle to the longitudinal axis. The junction of the first portion and the second portion has a width normal to the plane of the arcuate member that is greater than the width at a tip of the second portion.

In another embodiment, an underwire for use in supporting garments comprises a generally arcuate member defining a longitudinal axis and having a first portion extending from a first end that includes a majority of the length of the arcuate member. A second portion is connected to the first portion that includes the remainder of the arcuate member such that the second portion has a taper defining a zone of increased flexibility. The taper includes at least one inclined surface reducing the cross-sectional area of the second portion transverse to the longitudinal axis from the connection of the first portion and second portion to a tip of the second portion. The taper provides a zone of substantially greater flexibility than the first portion in response to a force applied in a general direction that is normal to said at least one inclined surface of the arcuate member.

In a different embodiment, a method of making a zone of flexibility in an underwire for use in supporting garments comprises providing an arcuate underwire having a first portion joined with an end portion and means for tapering an underwire. The underwire defines a longitudinal axis and a longitudinal plane. The underwire has a cross-sectional area transverse to the longitudinal axis and forms a zone of increased flexibility on the end portion by using means for tapering. The means for tapering reduces the cross-sectional area of the end portion transverse to the longitudinal axis from the joining of the first portion and the end portion to a tip of the end portion.

This embodiment further includes making a zone of flexibility in an underwire wherein the means for tapering is a stamping machine. The means for tapering can also be a machining apparatus. At least a portion of the tapering can be formed during the fabrication of the underwire.

In still another embodiment, a method of fabricating an underwire comprising a zone of flexibility comprises the steps of providing an underwire and a stamping apparatus having at least one tapered stamping die. The underwire defines a longitudinal axis and has a first portion joined to an end portion. The end portion has a first surface and an opposed second surface that defines a zone of increased flexibility.

A first increment is inserted along the longitudinal axis of the end portion into a stamping apparatus. The stamping of the first increment reduces the cross-sectional area transverse to the longitudinal axis of that increment. The stamping of a second increment and the first increment along the longitudinal axis reduces the cross-sectional area transverse to the longitudinal axis of the second increment and the first increment. By progressively stamping additional increments along the longitudinal axis of the second portion in an overlapping manner up to the first portion, the stamping defines. The taper at the joining of the first portion and the end portion has a first cross-sectional area transverse to the longitudinal axis larger than and a second cross-sectional area transverse to the longitudinal axis at a tip of said end portion.

In this embodiment, progressively stamping can further includes tapering the first surface at an acute angle inclined towards the longitudinal axis. Progressively stamping can further include tapering the first surface such that the first surface defines a plane. Progressively stamping can also further include simultaneously tapering the first surface and the second surface at acute angles inclined towards the longitudinal axis.

Additional features and advantages of the invention are set forth in the detailed description which follows, and will be readily apparent to those skilled in the art from that description or by practicing the invention as described herein, including the claims and the appended drawings.

BRIEF DESCRIPTION OF THE DRAWINGS

FIG. 1A is a top plan view of a typical prior art underwire assembly that is provided with cushion tips;

FIG. 1B is a side elevation view of the prior art underwire assembly of FIG. 1A;

FIG. 11A is a top plan view of a portion of the end of a hinged underwire in accordance with another embodiment of the invention;

FIG. 11B is a right side view of the underwire illustrated in FIG. 11A;

FIG. 12A is a top plan view of the end member of a hinged underwire;

FIG. 12B is a side view of a portion of the end of an arcuate underwire that is adapted to receive the end member of FIG. 12A;

DETAILED DESCRIPTION OF THE PREFERRED EMBODIMENTS

Figures 2, 3A, 3B, 4:
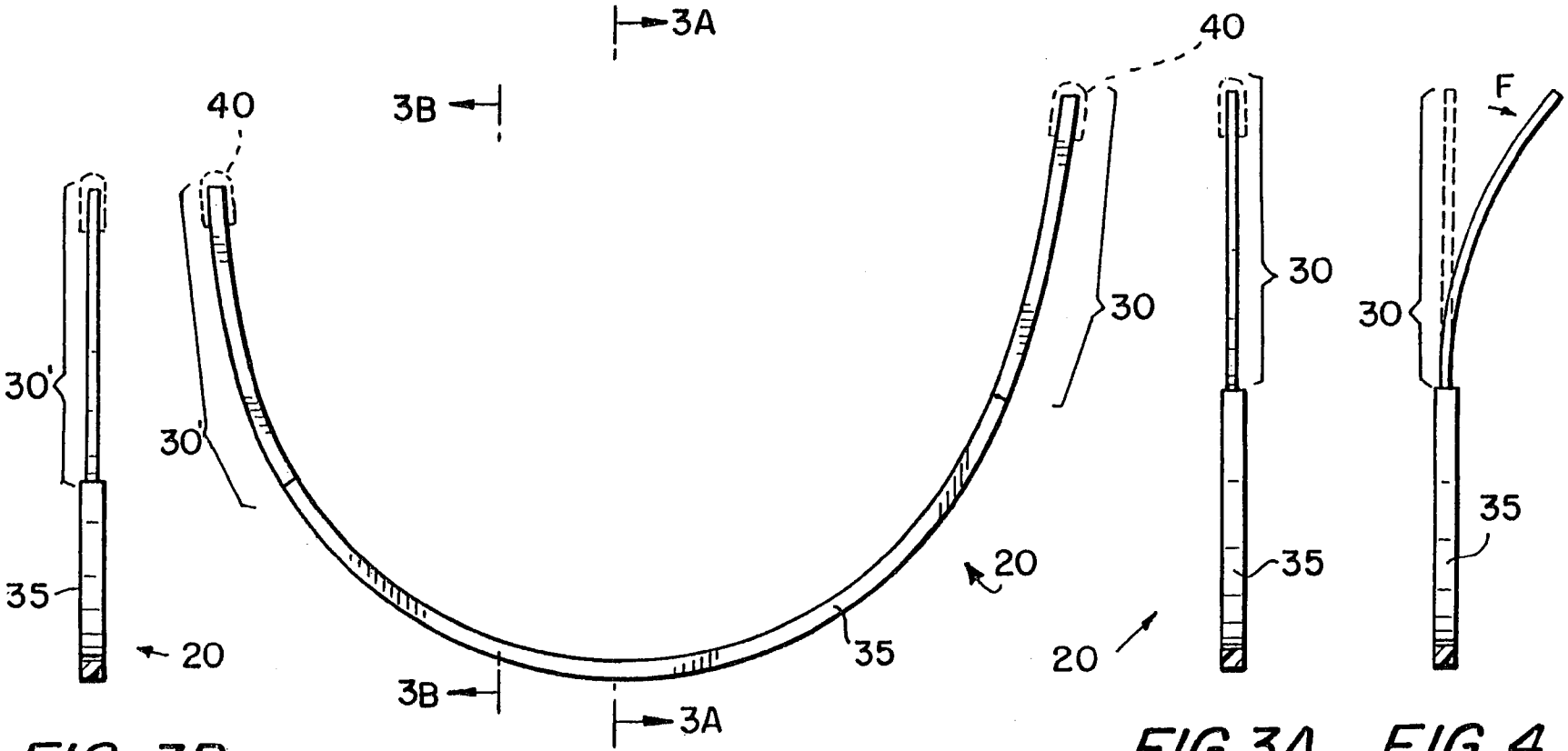
FIG. 2 is top plan view of an improved flexible brassiere underwire in accordance with one embodiment of the present invention.
FIG. 3A is a cross-section view taken along section line 3A—3A of FIG. 2.
FIG. 3B is a cross-sectional view taken along section line 3B—3B of FIG. 2.
FIG. 4 is a cross-sectional view similar to FIG. 3A with an end portion in a laterally displaced position.
Figure 5A:
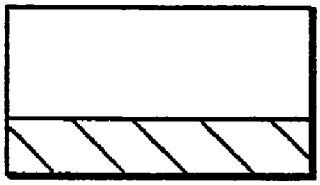
FIGS. 5A–5F are cross-section views of a portion of arcuate members of increased flexibility in the direction of an intermediate portion of greater cross-sectional area.
Figure 5B:
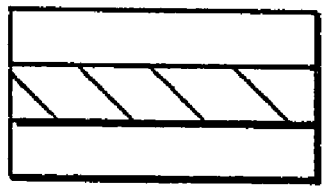
Figure 5C:
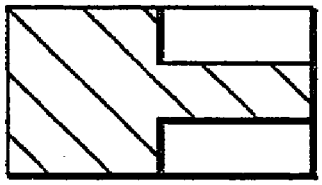
Figure 5D:
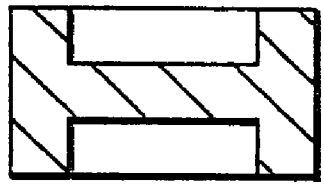
Figure 5E:
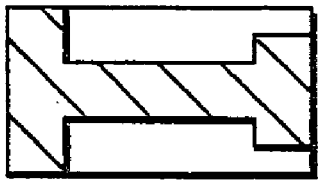
Figure 5F:
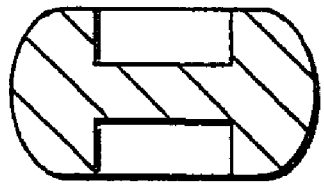

Reference will be made to several preferred embodiments of the invention, examples of which are illustrated in the accompanying drawings FIGS. 2–6.

Wherever possible, the same reference numbers will be used throughout the drawings to refer to the same or like elements.

An exemplary embodiment of an underwire assembly of the prior art is shown in FIG. 1, designated generally by reference numeral 100. The opposing ends 120 are fitted with cushion tips 140. In the embodiment of FIGS. 1A and 1B, the underwire 110 is fabricated from metal and its longitudinal axis "L" lies in longitudinal plane "P". This type of prior art underwire resist forces that would tend to change the lateral distance "d" between the tips 140. Although not entirely rigid, the underwire also resists twisting forces of the type that are developed when the underwire 110 is sewn into place in the supporting garment (not shown).

The cross-section of the prior art underwire taken along substantially the entire longitudinal axis is uniform, e.g., rectilinear, as shown in FIG. 1B. Some departure from the uniform cross-section may appear at the extreme ends in order to accommodate or provide a structure for mounting cushion tips. For example, it is known to provide one or more perforations at one or both ends of the underwire lo for slidably or pivotally mounting the soft cushion tip. However, these modifications to the end of the underwire have no appreciable effect on the flexibility of the adjacent end portion(s) of the underwire on which such movable tips are mounted. That is to say, such modifications as are known to the prior art do not provide a zone of flexibility as contemplated by the configuration and method of the present invention.

As will be understood by one of ordinary skill in the art, the underwires of the prior art, including those fitted with soft movable cushion tips at the end positioned on the wearer's side often cause discomfort. This is due to the fact that the change in effective longitudinal length of the underwire fitted with a slidably moveable tip is insufficient to relieve the lateral pressure applied to wearer's torso by the relatively inflexible end portion of the underwire.

Referring now to FIGS. 2–4, there is depicted one embodiment of the improved underwire of the invention. Underwire assembly 20 is a monolithic arcuate U-shape member 10 having opposing ends, a predetermined length or a portion of at least one end defining a zone of increased flexibility 30. When placed in position in the supporting garment, e.g., a brassiere, this zone of increased flexibility 30 will be proximate the wearer's side or underarm. The opposite end portion 30' is located distal to portion 30 and an intermediate portion 35 is located between and integrally formed with the first and second portions. As shown in the side view of FIG. 3A, the zone of increased flexibility 30 enhances the comfort of underwire 20 for the wearer by permitting improved lateral flexibility during physical activity and body movements, or simply by allowing the end to extend outwardly away from the wearer's side or underarm in response to the lateral force(s) exerted by the wearer's torso.

In a preferred embodiment depicted in FIGS. 2, 3A and 3B, the zone of increased flexibility 30 includes a predetermined length of a first end portion having a substantially smaller cross-sectional area than the cross-sectional area of the adjacent intermediate or remaining portion of the underwire, thereby providing greater lateral flexibility to the first end portion.

In the embodiment illustrated in FIG. 2, both terminal or end portions 30 and 30' are provided with zones of increased flexibility 30 relative to the intermediate portion 35, thereby improving the lateral flexibility of both end portions of underwire 20. The desirability of increasing the flexibility of both end portions will be based on a number of factors, including the nature of the supporting garment and the design and material of construction of the underwire.

As shown in FIG. 4, application of a lateral force F causes a displacement of zone 30, while having little or no effect on the more rigid adjoining portion.

The region of enhanced flexibility is preferably formed by shaping, molding, thinning or removing underwire material, such as by grinding, abrading, stamping, extruding, rolling or etching a predetermined length of the underwire or by joining materials of different cross-sections and/or flexibilities. The underwire can be metallic or nonmetallic, uncoated or coated over all or part of its length with a polymer coating, the composition of which is well-known to the art. The outermost ends of first and second terminal end regions preferably include cushion tips or dip tips 40 of a resilient material, such as a soft plastic, soft resin or the like, to coat sharp edges that may be present.

In the practice of the invention, particularly with metal underwires, it is important that the rigidity of the arcuate member with respect to its original, unstressed arcuate shape or configuration be maintained. This characteristic, which will be referred to as "arcuate rigidity," is important to the function of the underwire in maintaining the shape of the brassiere or other supporting garment.

In view of the above considerations, several preferred embodiments of the portion of increased flexibility of the arcuate member are illustrated in the cross-sectional views of FIGS. 5A–5F. As shown in these figures, the portion or portions of increased flexibility have a transversely extending segment that is of the same width, or substantially the same width as the original width of the intermediate portion, or adjacent segment(s). This construction allows a lateral bending or displacement of the underwire, while at the same time, minimizing the effect of the reduced cross-sectional area on the desired arcuate rigidity.

Figure 7:
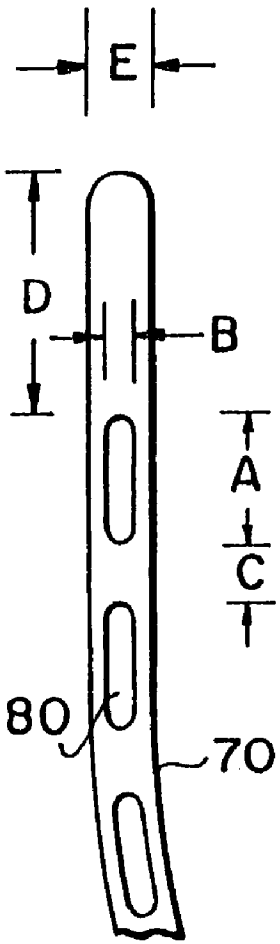
FIG. 7 is a dimensioned detail of the underwire of FIG. 6.
Figure 6:
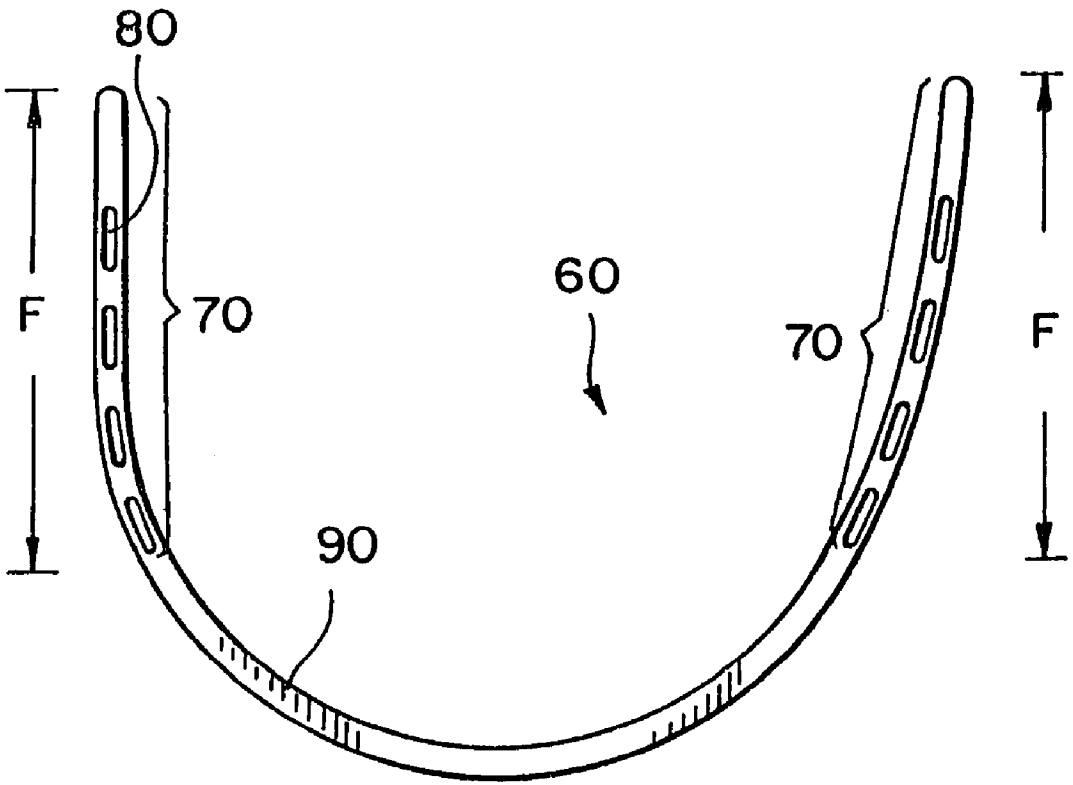
FIG. 6 is a top plan view of an underwire in accordance with another embodiment of the present invention.

In another preferred embodiment, illustrated in FIGS. 6 and 7, underwire 60 is shown with zones of increased flexibility defined by a predetermined length of both first and second terminal end portions 70 having perforations 80 located therein. As a result of the reduction in the average cross-sectional area, first and second terminal end portions have greater lateral flexibility relative to the flexibility of the intermediate portion 90, thereby improving the comfort of underwire 80.

Although not specifically depicted in the attached illustrative drawings of the invention, it is to be understood that the underwires formed from metal include generally rounded quarter-fillets where the narrower portions meet the portions of larger cross-section. These fillets provide enhanced strength to the construction and reduce the tendency of the metal to form cracks that propagate from sharp inside corners or shoulders. Similarly, fillets are also provided in the molded polymeric underwires, where they serve a similar purpose and also facilitate removal of the piece from the mold.

As depicted in FIGS. 6 and 7, openings 80 are oblong; circular or other shapes can be employed to define the perforations or opening(s) 80. In the specific embodiment illustrated, the openings 80 are about ¼ in. long and about 1/16 in. wide. There is preferably about ⅛ in. between adjacent perforations, preferably about 2 in. between the top of the first perforation and the end of the underwire, and preferably about 2 in. from the outermost end of the underwire to the lowermost portion of the last perforation. The first and second terminal end portions depicted in FIGS. 6 and 7 can also include cushion tips or dip tips (not shown).

Figure 8:
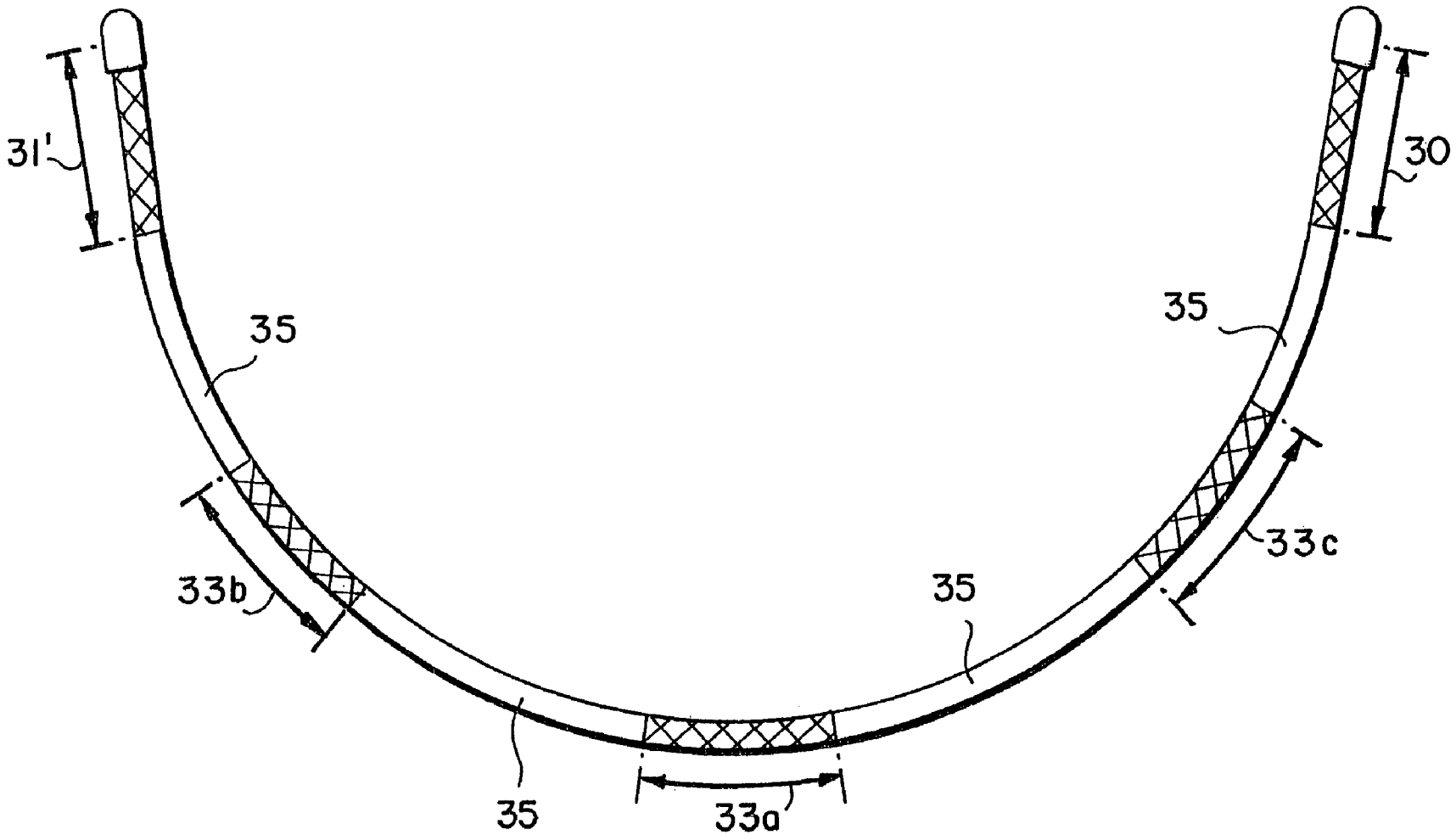
FIG. 8 is a top plan view of an underwire in accordance with another embodiment of the invention.

A further preferred embodiment of the invention is schematically illustrated in FIG. 8 where there is depicted an arcuate member 20 having a plurality of zones of increased flexibility in spaced relation along the longitudinal axis of the intermediate portion 35. It is to be understood that the number, spacing, axial length and relative flexibility is determined based upon the design factors discussed above. These design factors can include the size of both the supporting garment and the cup, the style and type of the garment, as well as its material(s) of construction.

With continuing reference to FIG. 8 the underwire has zones of increased flexibility at opposing end portions 30 and 31; in the region of the underbust 33*a*; in the vicinity of the breastbone 33*b*; and proximate the ribcage 33*c*. The intermediate portions 35 are of consistent cross-sectional area that is greater than the cross-sectional areas of the respective zones of increased flexibility 30, 31, 35*a*–35*c*. The cross-section configuration of each of the zones of increased flexibility can be as shown in FIGS. 5A–5F.

Figures 9, 10:
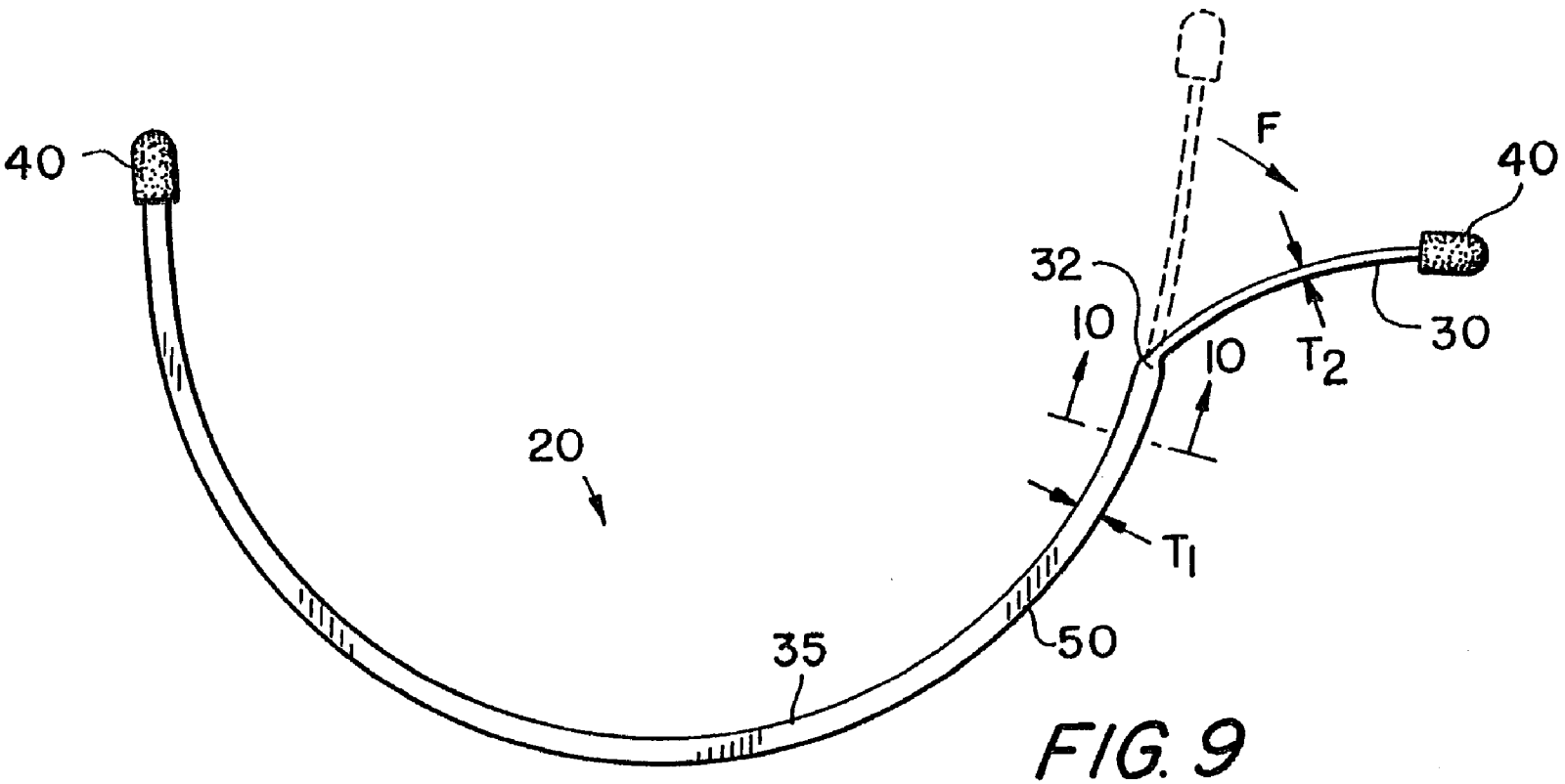
FIG. 9 is a top plan view of an underwire in accordance with another embodiment of the invention.
FIG. 10 is a cross-sectional view taken along line 10—10 of FIG. 7.

With reference to the embodiment illustrated in FIG. 9, the underwire 20 is formed of a molded polymer. As shown in FIG. 10, the cross-section of the majority of the arcuate member 50 is square, or nearly so. The zone of increased flexibility 30 is preferably joined to the first portion 50 by a tapered transition portion 32. The transition portion 32 is provided to minimize stress, strain and fracture points that are known to occur in the molding of various polymeric compounds.

The transverse or lateral thickness $T_1$ of first portion 50 is substantially greater than the corresponding thickness $T_2$ of second end portion 30.

In the embodiment illustrated in FIGS. 9 and 10, the width of the first and second portions are the same, or nearly so. Alternatively, both the thickness and width of the end portion can be varied over the length of zone 30 to achieve the desired degree of relative flexibility for a particular garment, based on its size, style and the choice of materials from which the garment and the underwire are produced. As shown in FIG. 9, when a lateral force F is applied to portion 30 it bends elastically without permanent deformation.

When the underwire is produced from a molded polymer, the end portion 30 can be of approximately the same width as the more rigid intermediate portion 35, but turned at an angle to the plane of the longitudinal axis of the rest of the underwire 20. The angle can be made up to 90°. The optimum angle of displacement from the plane is determined with reference to the type and style of the garment, and the other factors described above.

In an alternative embodiment similar to that shown in FIG. 9, the arcuate member is fabricated from a polymeric composition and the end portion for which greater flexibility is desired is defined by a transverse living hinge that is formed proximate the transition zone 32. The design and configuration of living hinges is well known in the art and is provided by molding the arcuate member with a relatively narrow region that is substantially thinner than end portion 82 and intermediate portion 70. The configuration of the living hinge must be such that the arcuate rigidity of the underwire is not substantially reduced, and the living hinge has sufficient tensile strength to resist tearing and stress fractures during the expected useful lifetime of the garment.

As will be apparent to those of ordinary skill in the mechanical arts, various other types and configurations of common structures, such as ball and socket joints can be utilized to permit lateral movement of the end portion of the underwire. As used herein, the term "hinge member" is intended to include the constructions specifically described above and their mechanical and functional equivalents.

The improved underwires of the invention can be produced from all of the materials from which underwires of the prior art have been produced. These include carbon steel, stainless steel and other metal alloys. Polymeric materials including, but not limited to, polyethylene, polypropylene, polyvinyl chloride, acrylonitrile-butadiene, styrene, methacrylates, polycarbonates, nylon and copolymers and homopolymers of these compounds.

Sufficient material must remain in the zone of increased flexibility 30 to avoid permanent deformation of the end portion. As will be understood by one of ordinary skill in the art, the relative reduction in cross-sectional area of the end portion(s), whether by thinning or perforations, can be determined for a particular application based on the type of material used to make the underwire.

In the illustrations of FIGS. 11A and 11B, one embodiment of a underwire 80 constructed with a hinge member 81 includes end portion 82 that is joined to intermediate arcuate portion 70 by a separate hinge pin 90. The leaf portion 84 is received for rotation in channel 72 and secured by pin 90. As will be understood from FIG. 11A, the channel 72 can be configured so that the end portion 82 is allowed to rotate in only one direction and up to a predetermined angular displacement.

In a further modification of the hinge member, there is illustrated in FIGS. 12A and 12B a molded plastic or formed metal end portion 82 is provided with a shallow recess or tapered orifice 92 formed in the leaf 84. The end of the intermediate portion 70 is provided with one, or a pair of integrally formed projecting engagement members, 74 that are adapted to receive and retain the recess or orifice 92 in end portion 84. In constructing the underwire assembly of this embodiment, the walls 76 forming the channel 72 are sufficiently resilient to receive leaf 84 in a snap-fit relation. As will be apparent to one of ordinary skill in the art, a single integrally molded hinge-pin can be molded in one side of channel 72 in place of the pair of opposed projecting retaining elements 74, and orifice 92 is sized to receive the pin in-close-fitting rotational relation.

Figure 13:
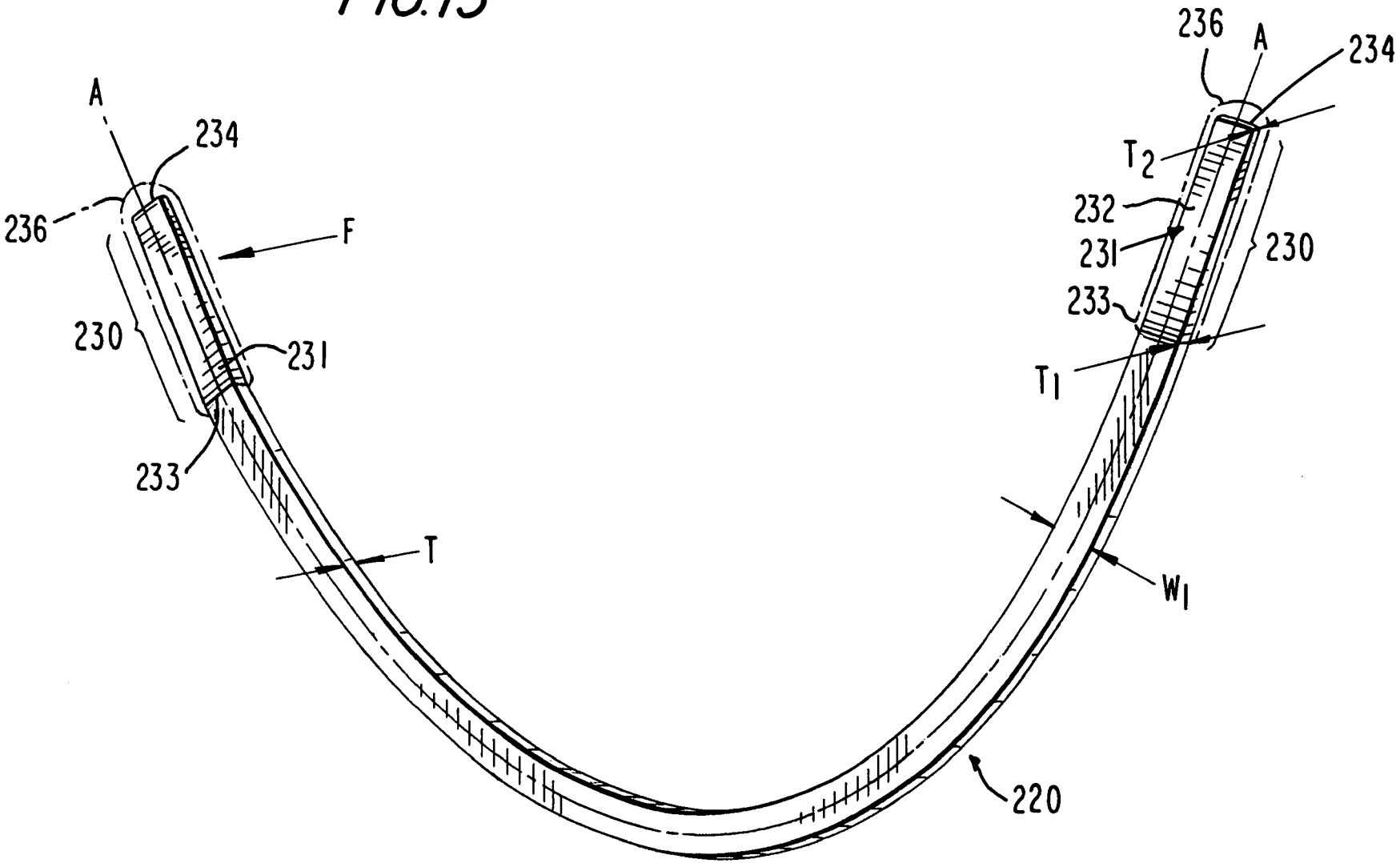
FIG. 13 is a front perspective view of an underwire assembly of the present invention, having at least one zone of increased flexibility defining a taper.
Figure 15:
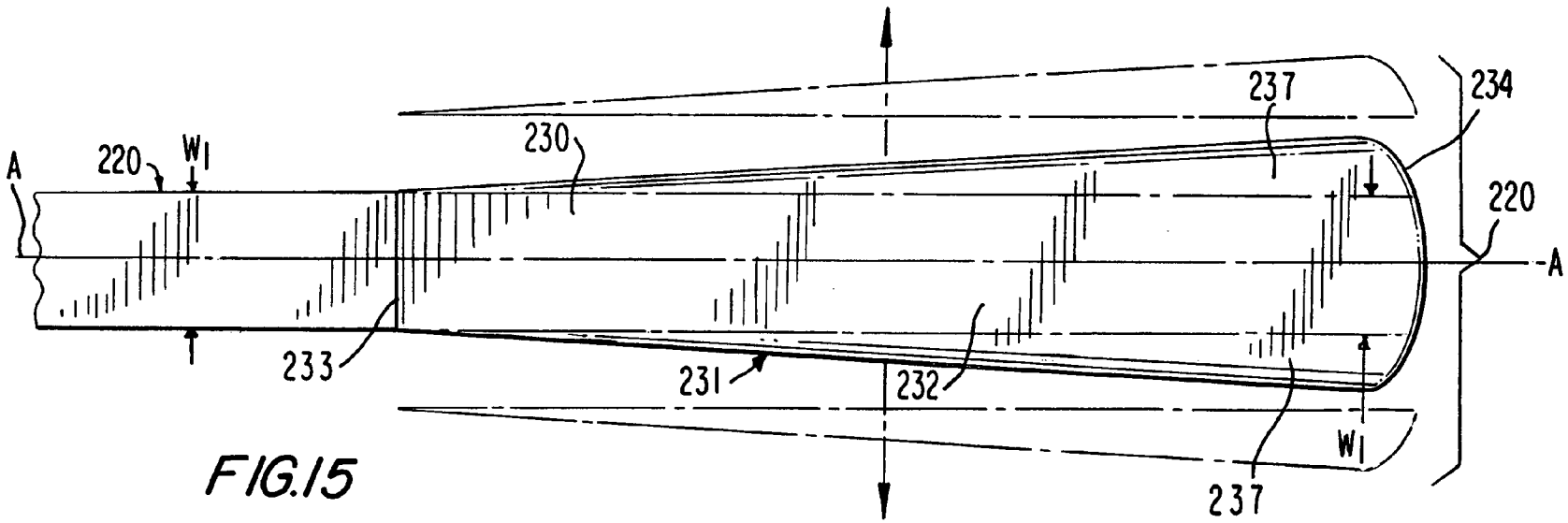
FIG. 15 is top plan view of the end portion of the underwire shown in FIG. 14, after the progressive stamping process shown in FIG. 14 has been completed, and before finishing by grinding.
Figure 16:
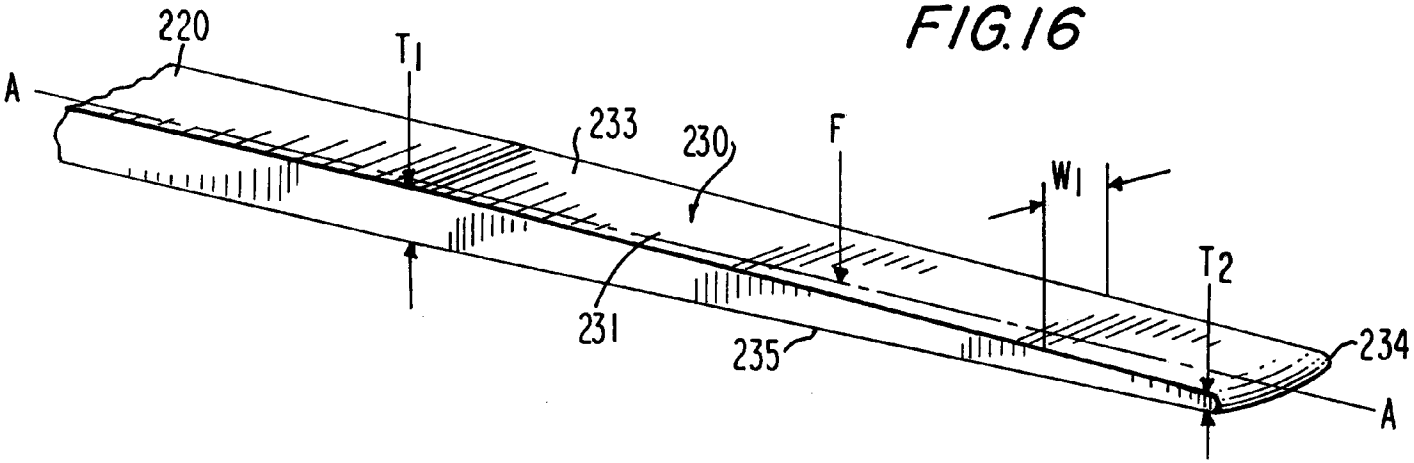
FIG. 16 is a left side perspective view from above, of the end portion of the underwire of FIG. 14, after the stamping and finishing processes have been completed.

Referring now to FIGS. 13 and 16, underwire. 220 is shown as a generally arcuate or U-shaped frame member including one or more zones of increased flexibility 230 having at least one taper. Underwire 220 may be arcuate in shape, generally less than semi-circular, approximately semi-circular, or it may extend in the longitudinal plane beyond the semi-circular for additional support. The generally arcuate U-shaped underwire 220 defines a longitudinal axis A—A shown in FIG. 13, which lies in longitudinal plane P—P, shown in FIGS. 13–18, and in the same location and orientation as shown in FIGS. 1A and 1B.

Underwire 220 preferably has a rectangular cross-section perpendicular to the longitudinal axis with a width $W_1$ greater than thickness $T_1$. The transverse width $W_1$ of underwire 220 is preferably uniform along the direction of the longitudinal plane, and preferably remains unchanged in the zone of increased flexibility 230 as shown in the preferred embodiment of FIG. 16. The thickness $T_1$ perpendicular to the longitudinal plane of the zone of increased flexibility 230 varies from thickness $T_1$, at the initiation of the taper 233 of the zone of increased flexibility 230 to thickness $T_2$, at tip 234. $T_2$ is less than $T_1$.

In one preferred embodiment, the thickness $T_1$ at the initiation of taper 233 is preferably about 0.023 inch and the dimension $T_2$ at the tip of the zone of increased flexibility is about 0.011 inch. The dimensions $T_1$, $T_2$, $W_1$ and $W_2$ and the degree of tapering between $T_1$ and $T_2$ can vary in individual applications and depend upon various factors such as the material of the underwire and specific needs of the user. Generally, however, it should be understood that $T_1$ is greater than $T_2$. The zone of increased flexibility 230 will generally retain the same arcuate rigidity as the remaining portions of underwire 220.

As seen in FIG. 16 taper 231 is defined by surfaces 231 and 235 advantageously provide a zone of increasing flexibility from the point 233 of initial taper to tip 234 when a force "F" is applied in a direction approximately normal to the longitudinal axis A—A. The taper defined by surfaces 231 and 235 preferably extends over the length of end portion 230 in a plane oriented at an angle acute to the transverse plane containing the longitudinal axis.

Referring now to FIGS. 13–19, underwire 220 is preferably made of metal and most preferably of a carbon steel alloy that is drawn and rolled to the desired shape. However, it should be understood that the basic underwire 220 having a zone of increased flexibility 230 can also be made of other materials and fabricated by other means.

Figure 14:
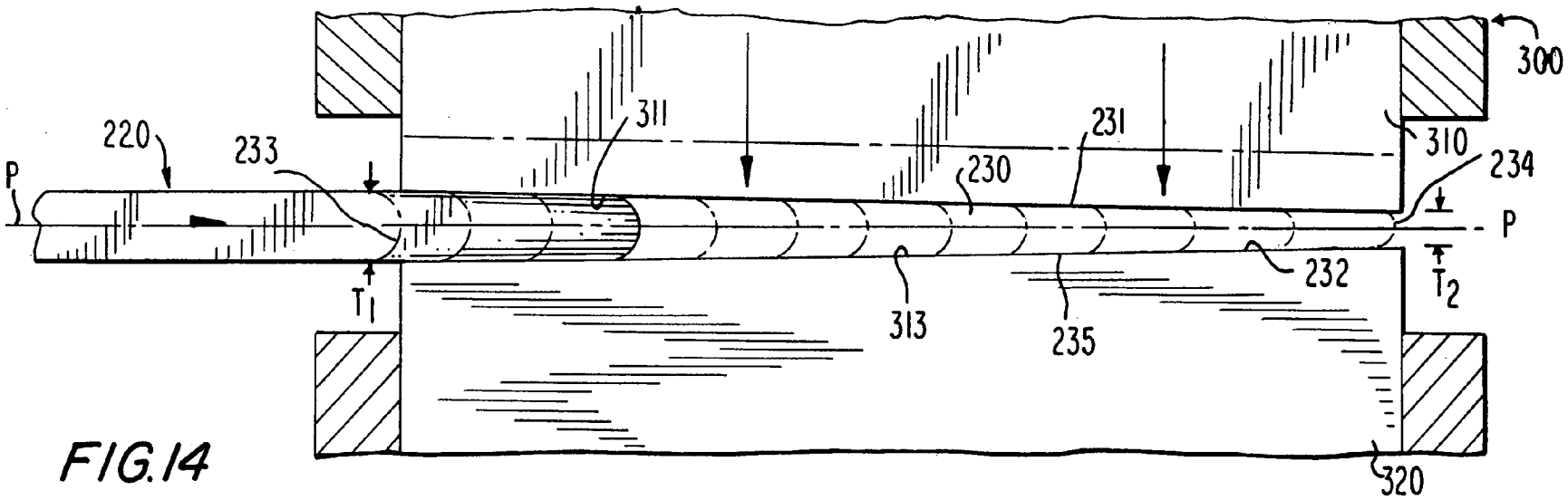
FIG. 14 is an elevational side view of an end portion of the underwire assembly of the present invention undergoing a progressive and overlapping series of stampings to define a zone of flexibility.

Referring to FIGS. 14 and 15 there is disclosed the latest preferred embodiments of the invention in the form of an underwire having zones of enhanced flexibility which are preferably formed by the progressive stamping process illustrated in FIG. 14. End portion 230 of the finished underwire 220 in the preferred embodiment shown is progressively formed into a taper 231 in the stamping machine 300 shown in FIG. 14, from the start or initiation of the taper 233 to the tip 234 of end portion 230. Stamping machine, or press 300 progressively tapers end portion 230 in a direction transverse to the longitudinal plane, or in the direction of the thickness $T_1$ of underwire 220. The beginning of taper 233 has a first thickness $T_1$ perpendicular to the longitudinal axis that is greater than a second thickness $T_2$, also perpendicular to the longitudinal axis at tip 234 of end portion 230.

Another preferred embodiment of the stamping process of the present invention will now be described. Stamping press 300 is shown with a first movable die 310 closing upon a fixed second die 320. Die surfaces 311 and 313 are preferably acutely angled from the horizontal to produce tapered surfaces 231, 235, both of which are inclined at a corresponding acute angle to the longitudinal axis on two opposing sides of end portion 230. Alternatively, press 300, however, can form a taper 231 on a single side or surface of end portion 230 by having a taper on a single die 310 or 320 and the opposing die 310 or 320 being horizontal and un-tapered. An adjustable stop or limit can be set on press 300 leaving a minimum gap between dies 310 and 320 for the desired thickness $T_2$ of the terminal end of tip 231.

As shown in FIG. 14, end portion 230 is progressively stamped between dies 310 and 320 in increments, beginning at tip 234. A predetermined distance or increment extending from tip 234 along end portion 230 is initially inserted and stamped between dies 310 and 320 for a first reduction of thickness in a direction generally perpendicular to the longitudinal axis and plane.

Dies 310 and 320 are then separated and the underwire stamping is inserted further into the stamping zone to include a second increment, as well as the first increment previously inserted. Die 310 is then moved downwardly to stamp the end portion 230 such that the first increment receives a second reduction in width and the second increment receives an initial reduction by press 300. By sequentially separating die 310 from die 320 and by progressively, sequentially and incrementally moving the end portion 230 into the stamping zone, end portion 230 will undergo a progressive and somewhat overlapping reduction to produce a taper.

The stamping progression continues until the entire length of the end portion 230 has been completely advanced into press 300 as illustrated in FIG. 14, and stamped to achieve the desired tapered zone of increased flexibility shown as an example in FIG. 16. Since the taper is progressively formed in this embodiment, there may be extremely minor lines of demarcation where each stamping overlaps or meets a previous stamping. However, both surfaces 231, 235 are sufficiently continuous and smooth so as to avoid any one single point or multiple defined points of flexure that can potentially create stress concentrations and lead to structural fatigue after repeated flexing.

In the stamping procedures disclosed herein, one die may be held fixed, and the other die made to be movable toward and away from the stamping zone. Alternatively, both dies may be movable, toward and away from the stamping zone.

In one preferred embodiment, each increment of length along end portion 230 for stamping is between about 0.2 and about 0.5 inch, but this can be varied depending upon the size of the underwire, the materials of construction of the underwire and the limitations of press 200. The progressive advancement of end portion 230 into press 300 can be performed manually or automatically. Zone 230 preferably has a length along underwire 220 of between about 1.5 to 2 inches; however this dimension can vary depending upon the length of underwire 220 and the length of the desired zone of flexibility.

As shown in FIGS. 14 and 15, the initial stamping process results in extruded metal portions 237 extending laterally outwardly from end portion 230. Extruded metal portions 237 on either side extend both parallel and transverse to the longitudinal plane depending upon the shape of dies 310 and 320 relative to end portion 230. According to the invention, the extruded metal portions 237 are then removed using known techniques in the industry such as grinding, cutting, abrading, machining and/or etching. End portion 230 as shown in one preferred embodiment in FIG. 16, has the same general thickness at 233 as the remaining portion of underwire 220. Prior to installation in a brassiere or garment, underwire 220 can also include a sleeve in the form of a heat shrink type sleeve, for example, and a soft cushion tip, such as a comfort tip or dip tip. Alternatively underwire 222 may be finished with a bulbous tip 236 as illustrated in FIG. 1.

Referring now to FIGS. 15 and 16, flexible zone 230 is shown after completing the finishing processes such as removing extruded metal portions 237, surface treatments, coatings and rounding of edges as described or shown previously. The tapered surfaces of end portion 230 between the initial point of taper 233 and tip 234 can include a plurality of graduated steps, concave portions, planar portions, undulations, apertures or combinations thereof, depending upon the desired degree of flexibility.

Alternatively underwire 220 may be provided with a cross-section such that the zone of increased flexibility 230 is oriented to flex in any direction between the lateral direction within the longitudinal plane and perpendicular to the longitudinal plane. This can include stamping and then twisting of underwire 220 up to 90°, or stamping underwire 230 such that the two inclined surfaces 232 are positioned within the brassiere for primarily flexing at an angle of 45°. Alternatively, underwire 230 can be positioned to flex at an angle ranging from generally perpendicular or normal to the longitudinal plane to about a 60° angle from the longitudinal plane, for example.

In a further alternative embodiment, tapered end portion 230 can be formed subsequent to initial fabrication by machining, shaping, rolling, grinding, abrading, extruding, cutting or etching process well known in the industry.

Figure 17:
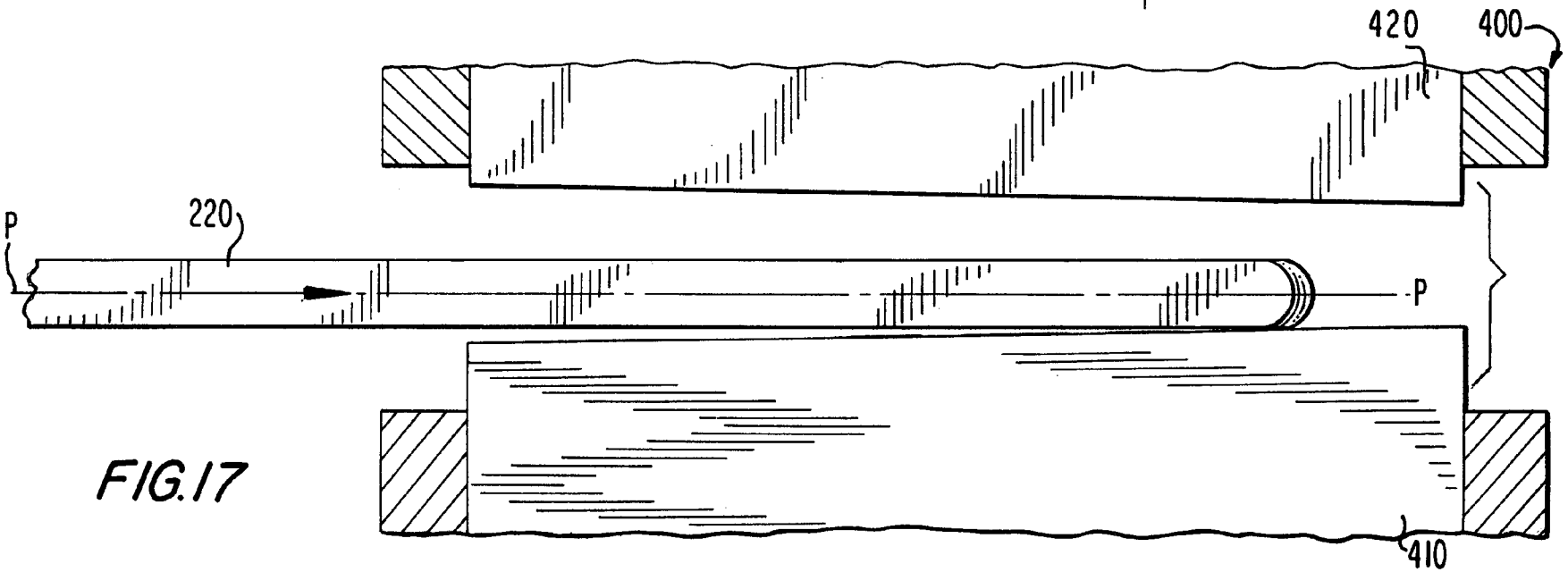
FIG. 17 is a side elevational view of one of the end portions of the underwire assembly of the present invention prior to stamping by an alternative single step stamping method.
Figure 18:
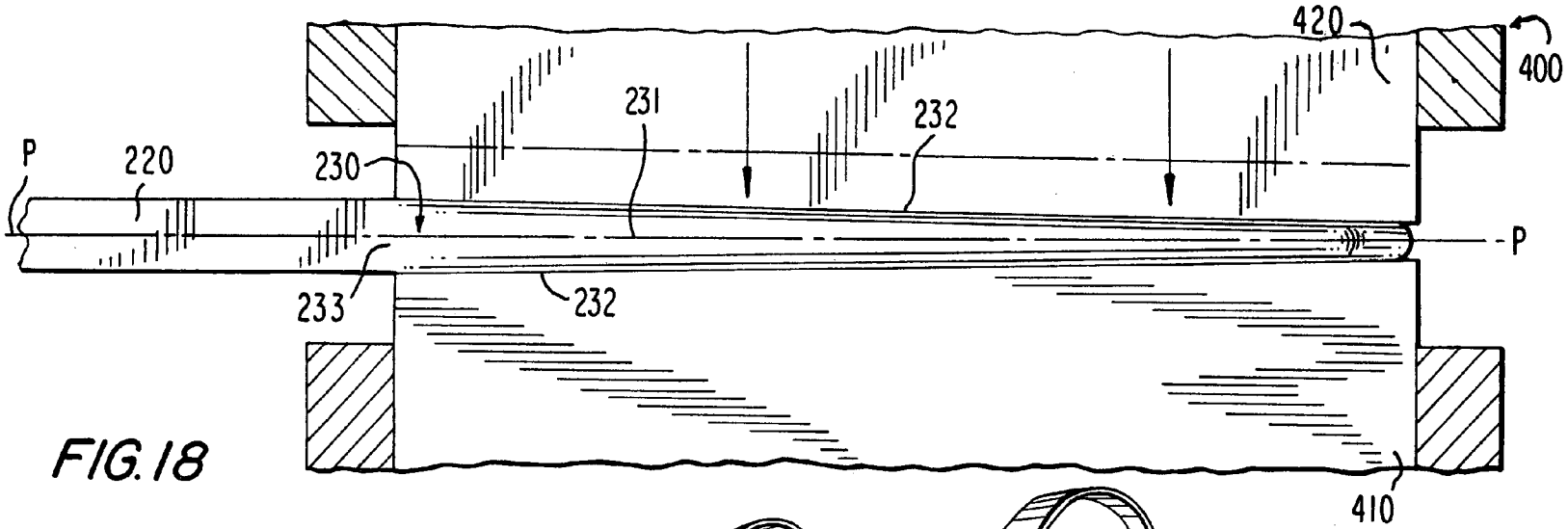
FIG. 18 is a side elevational view of the end portion of the underwire assembly of FIG. 17 being stamped into a tapered shape by the single step stamping method of FIG. 18.

As shown in FIGS. 17 and 18, in an alternative embodiment, press 400 can be made to receive and stamp the entire end portion 230 intended to be tapered. The full length of end portion 230 can then tapered simultaneously into the shape of FIG. 16, for example, by one (or possibly more) stampings of dies 410 and 420.

Figure 19:
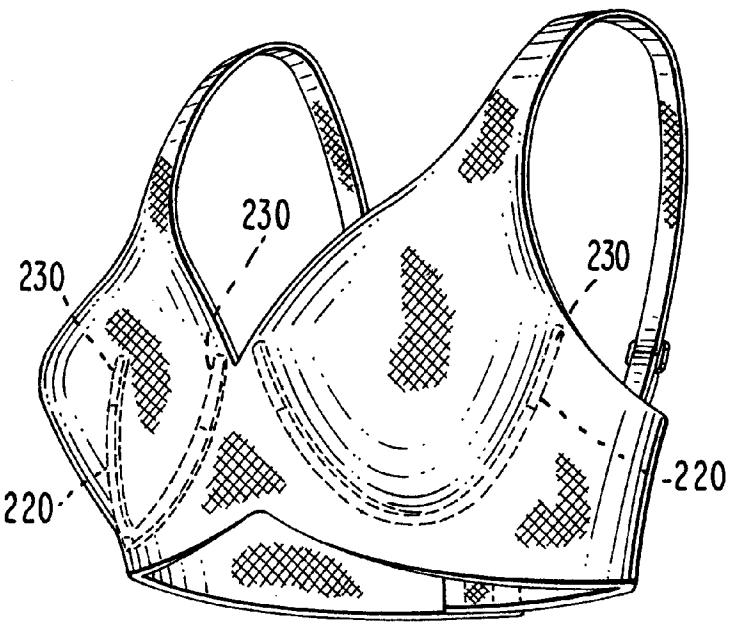
FIG. 19 is a right side perspective view from below, of a brassiere incorporating the underwire assembly of the present invention.

As depicted in FIG. 19, underwire 220 having tapered end portions 230 according to the invention are positioned for use in a brassiere at least proximate to a wearer's sides or underarms. Each underwire 220 includes a zone of flexibility 230 at one or both end portions that advantageously accommodate an increased range of unrestrained movement by a user.

The underwire of the present invention may be provided with flexible comfort tips 236, as shown in FIG. 1, of the type disclosed in commonly assigned U.S. Pat. Nos. 6,780,080 and 5,830,040, the disclosures of which are incorporated herein and made a part of this disclosure.

As will also be understood by one of ordinary skill in the art, as well as by sales and fitting personnel, and even wearers of supporting garments, the discomfort experienced by individuals wearing the same supporting garment can be in different areas of their respective torsos. For this reason, it is another aspect of the invention to provide a department store or other specialty retailer with trial fitting garments from which the underwire of the invention to provide a department store or other specialty retailer with trial fitting garments from which the underwire of the invention can be removed and replaced with an alternative underwire to maximize the comfort of the wearer.

For example, the prospective buyer will first try on a brassiere having a standard underwire of the prior art for the purpose of identifying any pressure points or discomfort zones associated with bending, twisting or other movement and positions of the torso. The sales person will take note of any such locations and then select from a collection of properly sized underwires, one that includes the one or more zones of increased flexibility that correspond to the discomfort zones identified by the prospective buyer. A second trial fitting proceeds as above, and if satisfied, the buyer is provided with a new brassiere into which is assembled the selected underwire.

The underwires are permanently sealed into the receiving channel or sleeve, as by fabric adhesive applied by the sales personnel, or by simple tacking or stitching. The underwire can be provided with a hot melt adhesive that is activated by a clothing iron or microwave radiation. Alternatively, the garment can be provided with a retaining flap or overlapping pocket at the open end of the sleeve that is closed after insertion in order to retain the underwire. In another embodiment, the channel or sleeve can be closed using ultrasonic or sonic sealing methods and apparatus that are well known in the art.

In this manner, the wearer can be provided with a custom fitting of the garment, for which comfort and service a premium price can be charged.

It will be apparent to those skilled in the art that various modifications can be made to the present invention without departing from the spirit and scope of the invention. It is therefore intended that the present invention encompass all such modifications and variations so long as they fall within the scope of the appended claims and their equivalents.

What is claimed is:

1. An underwire for brassieres, which comprises:

a generally U-shaped arcuate member having a first terminal end portion, a second terminal end portion, and an intermediate portion located between said first and second terminal end portions;

at least one of said terminal end portions of said arcuate member including a flexible zone of predetermined length, said flexible zone being generally tapered such that said at least one terminal end portion has greater flexibility than said intermediate portion.

2. The underwire according to claim 1, wherein said taper of said flexible zone is defined by at least one outer surface portion oriented at an acute angle to a longitudinal axis defined by said U-shaped arcuate member.

3. The underwire according to claim 1, wherein said tapered flexible zone has a generally rectangular cross-section transverse to said longitudinal axis, the area of said cross-section being progressively reduced between the point of initiation of the taper to the tip of said terminal end portion.

4. The underwire according to claim 3, wherein said arcuate member is made of metal and said at least one terminal end portion is tapered in a stamping press by progressively increasingly inserting incremental portions of said terminal end portion into said stamping press and applying stamping forces thereto.

5. An underwire for use in supporting garments, which comprises:

a generally U-shaped arcuate member which defines a longitudinal axis which lies in a first plane, said arcuate member having at least a first end portion and a second end portion;

at least one of said first and second end portions of said arcuate member being tapered in at least one second plane perpendicular to said first plane to provide substantially greater flexibility than an adjacent portion in response to forces applied in said second plane in directions generally perpendicular to said first plane of said arcuate member, whereby said one end portion defines a zone of increased flexibility.

6. The underwire according to claim 5, wherein said taper is in at least one plane and the cross-sectional area transverse to the longitudinal axis of the tapered end portion is progressively reduced from a point of initiation of said tapered end portion to a tip of said end portion.

7. The underwire according to claim 5, wherein said taper is in two mutually perpendicular planes and said cross-sectional area transverse to the longitudinal axis of the end portion is reduced from a point of initiation of said end portion to a tip of said end portion.

8. The underwire according to claim 5, wherein said taper is in at least one plane and is defined by a single surface oriented at an acute angle to the longitudinal axis, the opposite surface being parallel to said longitudinal axis.

9. The underwire according to claim 5, wherein said arcuate shaped member has a sleeve at least partially positioned thereabout.

10. The underwire according to claim 9, wherein said sleeve is a heat shrink sleeve.

11. The underwire according to claim 7, wherein said tip of said end portion includes a protective cover.

12. The underwire according to claim 7, wherein said protective cover is a comfort tip or a dip tip.

13. A method of producing a garment supporting underwire having, at least one zone of flexibility, comprising the steps of:

providing a generally U-shaped arcuate member defining a longitudinal axis and having at least a first end portion, said first end portion having a first surface and an opposed second surface spaced by a thickness transverse to the longitudinal axis between said first surface and said second surface, said longitudinal axis lying in a longitudinal plane;

inserting at least a first increment of said first end portion along said longitudinal axis into a stamping apparatus, said stamping apparatus having at least one die surface oriented at an acute angle to said longitudinal plane containing said longitudinal axis; and stamping said at least said first increment of said first surface along the longitudinal axis to taper said surface so as to fabricate a zone of increased flexibility and reducing the thickness between said first surface and said second surface transverse to said longitudinal axis.

14. The method according to claim 13, further comprising inserting a second increment of said first end portion into said stamping apparatus and simultaneously stamping said first and second increments.

15. The method according to claim 14, further comprising progressively inserting increasingly incremental portions of said first end portion into said stamping apparatus and sequentially stamping said portions until said end portion is tapered in its entirety.

16. The method according to claim 15, further comprising removing excess laterally extruded material to provide a uniform lateral width for said first end portion.

17. The method according to claim 16, wherein said excess laterally extruded material is removed by grinding.

18. The method according to claim 17, wherein said generally U-shaped arcuate member has a second end portion and said end portion is tapered by incrementally stamping said second end portion.

19. The method according to claim 18, wherein said laterally extruded material is removed from said second end portion to produce a uniform lateral width thereof.

20. The method according to claim 19, wherein said laterally extruded excess material is removed from said second end portion by grinding.

21. The method according to claim 13, wherein the step of stamping further includes tapering at least said first surface at an acute angle relative to said longitudinal axis.

22. The method according to claim 13, wherein said step of stamping further includes tapering said first surface in a manner such that said first surface defines an at least substantially flat plane relative to said longitudinal axis.

23. The method according to claim 13, wherein said step of stamping further includes simultaneously tapering said first surface and second surfaces in at least one stamping step such that said first and second surfaces respectively assume acute angles inclined relative to said longitudinal axis.

24. The method according to claim 13, wherein said stamping apparatus includes at least a first die having an inclined first die surface and an opposed second die surface.

25. Method of custom-fitting a supporting garment that includes an underwire to a wearer of the supporting garment, the method comprising:

a. providing a plurality of underwires, each underwire being defined by an arcuate member having one or more tapered end portions of greater lateral flexibility than an adjacent portion along the longitudinal axis of the underwire;

b. placing a first underwire selected from the plurality of underwires in supporting position in the supporting garment;

c. placing the supporting garment on the wearer;

d. identifying any locations of discomfort caused by the underwire to the wearer;

e. replacing the first underwire with a second underwire having one or more portions of greater flexibility that correspond to the location or locations of discomfort when the second underwire is placed in the supporting garment;

f. repeating step d and step e, if necessary, until the discomfort to the wearer of the supporting garment is minimized; and g. securing the underwire resulting from step f in the supporting garment.

26. An underwire for brassiers, which comprises:

a generally U-shaped meatal arcuate member having a first terminal end portion, a second terminal end portion, and intermediate portion located between said first and second terminal end portions;

at least one of said terminal end portions of said arcuate member including a flexible zone of predetermined length, said flexible zone being generally tapered such that said at least one terminal end portion has greater flexibility than said intermediate portion.

27. A method of producing a garment supporting underwire having, at least one zone of flexibility, comprising the steps of:

providing a generally U-shaped metal arcuate member defining a longitudinal axis and having at least a first end portion, said first end portion having a first surface and an opposed second surface spaced by a thickness transverse to the longitudinal axis between said first surface and said second surface, said longitudinal axis lying in a longitudinal plane;

inserting at least a first increment of said first end portion along said longitudinal axis into a stamping apparatus, said stamping apparatus having at least one die surface oriented at an acute angle to said longitudinal plane containing said longitudinal axis; and stamping said at least said first increment of said first surface along the longitudinal axis to taper said surface so as to fabricate a zone of increased flexibility and reducing the thickness between said first surface and said second surface transverse to said longitudinal axis.

28. The method according to claim 27, further comprising inserting a second increment of said first end portion into said stamping apparatus and simultaneously stamping said first and second increments.

29. The method according to claim 28, further comprising progressively inserting increasingly incremental portions of said first end portion into said stamping apparatus and sequentially stamping said portions until said end portion is tapered in its entirety.

30. The method according to claim 29, further comprising removing excess laterally extruded material to provide a uniform lateral width for said first end portion.

* * * * *